US005621954A

United States Patent [19]

Mizuno

[11] Patent Number: 5,621,954

[45] Date of Patent: Apr. 22, 1997

[54] SLIDER FOR SLIDE FASTENER

[75] Inventor: Hiroshi Mizuno, Toyama-ken, Japan

[73] Assignee: YKK Corporation, Tokyo, Japan

[21] Appl. No.: 593,913

[22] Filed: Jan. 30, 1996

[30] Foreign Application Priority Data

Jan. 31, 1995 [JP] Japan ..... 7-013331
Sep. 29, 1995 [JP] Japan ..... 7-253113

[51] Int. Cl.[6] ..... A44B 19/00

[52] U.S. Cl. ..... 24/429; 24/387; 24/419

[58] Field of Search ..... 24/429, 419, 400, 24/370, 387, 437, 706; 294/3.6

[56] References Cited

U.S. PATENT DOCUMENTS 4,679,281 7/1987 Ishii et al. ..... 24/419
4,980,954 1/1991 Takabatake et al. ..... 24/419
5,031,286 7/1991 Kedzierski ..... 24/429
5,195,221 3/1993 Kanamaru et al. ..... 24/419

FOREIGN PATENT DOCUMENTS 2907232 9/1979 Germany ..... 24/387
0495390 11/1938 United Kingdom ..... 24/429

*Primary Examiner*—Victor N. Sakran
*Attorney, Agent, or Firm*—Hill, Steadman & Simpson

[57] ABSTRACT

In a slider for a slide fastener, front and rear attachment lugs are arranged on the upper surface of an upper wing of a slider body, each having a horizontal insertion hole and an arcuate guide surface contiguous to the insertion hole. A pull tab retaining bar has a length so as to bridge over the front and rear attachment lugs and has a pair of taper legs one on each end. For assembly, with a pintle of a pull tab placed between the two attachment lugs, the legs are forced into the insertion holes along the guide surfaces as they deform prastically, securing the pull tab retaining bar to the attachment lugs. Accordingly, the pull tab retaining bar can be attached to the slider body simply by pressing from the upper side, thus facilitating automatic assembling.

12 Claims, 13 Drawing Sheets

SLIDER FOR SLIDE FASTENER

BACKGROUND OF THE INVENTION

1. Field of the Invention

This invention relates to a slider for a slide fastener, and more particularly to a slide fastener slider which is of a three-member structure comprising a slider body, a pull tab and a pull tab retaining bar and hence the slider itself can be assembled in a simple manner.

2. Prior Art

A three-member slider for a slide fastener is already known which comprises a slider body, a pull tab and a pull tab retaining bar. As shown in FIG. 15, a slider is known (Japanese Utility Model Open-Laid Publication No. 59156512) in which the upper wing 4' of the slider body 1' has on its upper surface front and rear attachment lugs 7', 7", one opening outwardly and upwardly and having a longitudinal groove 9' and the other having an outwardly directed hook engaging portion 9", and in which the pull tab retaining bar 2' is a C-shape resilient bar having at one end a T-shape engaging portion 2'-1 to be fitted in the longitudinal groove 9' and at the other end a hook 2'-2 engageable with the hook engaging portion 9". For assembly, the pull tab retaining bar 2' is slid longitudinally on the upper surface of the slider body 1' to insert T-shape engaging portion 2'-1 into the longitudinal groove 9' after being threaded through an opening of the pull tab, and then the hook 2'-2 is pressed to come into engagement with the hook engaging portion 9", thus connecting the pull tab to the slider body 1'.

Also, as shown in FIG. 16, a slider is known (Japanese Utility Model Laid-Open Publication No. 60-4213) in which the upper wing 40' of the slider body 10' has on its upper surface C-shape front and rear attachment lugs 70', 70' mutually confronting and each opening upwardly, while the pull tab retaining bar 20' has at opposite ends a pair of legs 20'-1 each having a pair of recesses one on each side. For assembly, the legs 20'-1 of the pull tab retaining bar 20' is fitted in the respective attachment lugs 70', and then the side walls of each attachment lug 70' are clenched into the recesses, thus connecting the pull tab 30' to the slider body 10'.

Further, as shown in FIG. 17, a synthetic resin slider is known (Japanese Utility Model Laid-Open Publication No. 60-70308) in which the upper wing of the slider body 100' has on its upper surface front and rear attachment lugs 700' each having a longitudinal through hole, and a pair of grooves each communicating with the lower side of the respective through hole. And the pull tab retaining bar 200' has at opposite ends a pair of legs 200'-1 each having an outwardly directed hook. For assembly, the pull tab retaining bar 200' is pressed to cause the legs 200'-1 to resilienty deform so that the hooks are fitted and secured in the respective through holes of the attachment lugs 700', thus attaching the pull tab 300' to the slider body 100'.

In the first-named prior art of FIG. 15, the T-shape engaging portion 2'-1 formed at one end of the pull tab retaining bar 2' made of synthetic resin is fitted in the groove of one attachment lug 7', and the hook 2'-2 formed at the other end of the pull tab retaining bar 2' is resiliently deformed to come into engagement with the hook engaging portion 9" of the other attachment lug 7". Since the slider is molded of resilient synthetic resin and hence is assembled utilizing resilient deformation, this prior art cannot be applied to a slider which is made of metal and hence is unable to resiliently deform.

According to metallic slider of the second-named prior art of FIG. 16, since the legs 20'-1 at opposite ends of the pull tab retaining bar 20' cannot be fitted in the attachment lugs 70' easily and reliably, in the automatic assembling process of the slider which requires accuracy, it is impossible to improve the rate of production.

In the third-named prior art of FIG. 17, like the first-named prior art, since the slider is made of synthetic resin, and the hooks of the legs 200'-1 of the pull tab retaining bar 200' is resilienty deformable to be fitted in the through holes of the attachment lugs 700' during assembling, this prior art also cannot be applied to a slider made of metal.

SUMMARY OF THE INVENTION

It is a main object of this invention to provide a slide fastener slider made of metal which is consists of a three-member structure comprising a slider body, a pull tab and a pull tab retaining bar and the slider is suitable for automatic assembling and can be assembled easily and accurately, thus the rate of production is improved, the slider also having a simple mechanism of attachment of the pull tab.

Another object of the invention is to provide a slide fastener slider in which the pull tab attachment mechanism can be easily applied to a double-sided slider which can have a neat appearance.

Still another object of the invention is, by specifically defining a form of the slider body and the pull tab retaining bar, a slide fastener slider is provided in which the pull tab retaining bar can be easily attached vertically onto the slider body, as being easily deformed, in a stable manner. And the slide fastener has a mechanism for preventing accidental removal of the pull tab retaining bar from the slider body after attachment. And also the pull tab retaining bar is attached onto the slider body firmly and stably in a neat appearance.

Further object of the invention is, by specifically defining a form of the slider body and the pull tab retaining bar, a slide fastener slider is provided in which the pull tab retaining bar can be attached easily and stably onto the slider body horizontally, as being slid horizontally with ease and accuracy.

To accomplish the above objects, according to a first aspect of the invention, there is provided a slider for a slide fastener, comprising: a slider body having upper and lower wings; a pair of attachment lugs projecting from an upper surface of the upper wing, each attachment lug having an insertion hole and a guide surface contiguous to the insertion hole; a pull tab having a pintle; and a pull tab retaining bar having a pair of legs each adapted to be fitted in the insertion hole of each attachment lug so as to define between the pull tab retaining bar and the upper surface of the upper wing an opening through which the pintle of the pull tab is to be inserted.

The insertion hole of each of the attachment lug extends horizontally and longitudinally on the upper wing and the guide surface of the same attachment lug inclines sloping down to one end of the insertion hole. And the pull tab retaining bar has a generally Π shape with the legs projecting from a lower surface of the pull tab retaining bar at opposite ends and being plastically deformable when the pull tab retaining bar is pressed for attachment to the attachment lugs.

Preferably, the guide surface of each the attachment lug is arcuately curved, and each of the legs confronting and to be contacted with the guide surface is tapered off. And each attachment lug has a tongue to be pressed against the leg projecting from an inner end of the insertion hole toward the guide surface.

Also preferably, each of the attachment lug have on its upper surface a projection, and the pull tab retaining bar has in its lower surface at a position outside and near a base of each leg a recess in which the projection is to be fitted.

Preferably, a space is defined between an inner side wall of the insertion hole and the leg, and a wedge shaped claw for preventing removal of the leg is provided confronting the guide surface at a corner end of the insertion hole.

Further preferably, the pull tab retaining bar has a pair of covering strips extending from the respective ends for covering outer ends of the insertion holes of the attachment lug.

Preferably, the slider may be a double-faced type and further comprises another pair of attachment lugs projecting from a lower surface of the lower wing, another pull tab retaining bar, and another pull tab for being pivotally retained by the pull tab retaining bar.

According to a second aspect of the invention, there is provided a slider for a slide fastener comprising: a slider body having upper and lower wings; an attachment lug and a supporting lug projecting from an upper surface of the upper wing, the attachment lug standing on the upper surface of the upper wing at one end, while the supporting lug standing on the other side, and the attachment lug having an insertion hole and a horizontal guide surface contiguous to the insertion hole while the supporting lug has an enlarged head; a pull tab having a pintle; and a pull tab retaining bar having at one end a leg to be fitted in the insertion hole of the attachment lug so as to define between the pull tab retaining bar and the upper surface of the upper wing an opening through which the pintle of the pull tab is to be inserted. In the slider, an end of the pull tab retaining bar opposite to the leg is defined to be a socket which is adapted to accommodate and to be clenched against the supporting lug, whereby the pull tab retaining bar is attached onto the upper wing.

The supporting lug has a T-shape contour while the socket of the pull tab retaining bar is consisted of a surrounding wall closing three sides.

The horizontal insertion hole and guide surface of the attachment lug are in the same level with a top surface of the supporting lug, and the pull tab retaining bar has contact surfaces, which are touchable with the insertion hole, the guide surface and the top surface, in a common level.

Preferably, the slider also may be a double-faced type and further comprises another attachment lug and supporting lug projecting from a lower surface of the lower wing, another pull tab retaining bar, and another pull tab for being pivotally retained by the pull tab retaining bar.

In automatic assembly of the slider of FIGS. 1 through 11, the pull tab retaining bar is supplied to the slider body vertically from the upper side and is then attached to the slider body by plastic deformation. The assembled slider can be used as an ordinary slider; the attachment lugs and the pull tab retaining bar prevents the pintle of the pull tab from being removed off the slider body even when the pull tab is pulled in any direction to move the slider.

In automatic assembly of the slider of FIGS. 12 through 14, the pull tab retaining bar is supplied to the slider body horizontally from the rear side and is then attached to the slider body by clenching. This assembled slider also can be used as an ordinary slider; the attachment lug, the supporting lug, and the pull tab retaining bar prevents the pintle of the pull tab from being removed off the slider body even when the pull tab is pulled in any direction to move the slider.

DETAILED DESCRIPTION OF THE PREFERRED EMBODIMENTS

Various preferred embodiments of a slide fastener slider according to this invention will now be described in detail with reference to the accompanying drawings.

The slide fastener slider of this invention is obtained by assembling a slider body 1, 20, a pull tab retaining bar 2, 21 and a pull tab 3, 22, which are molded of metal having a low melting point such as aluminum alloy or zinc alloy by die casting.

Figure 1:
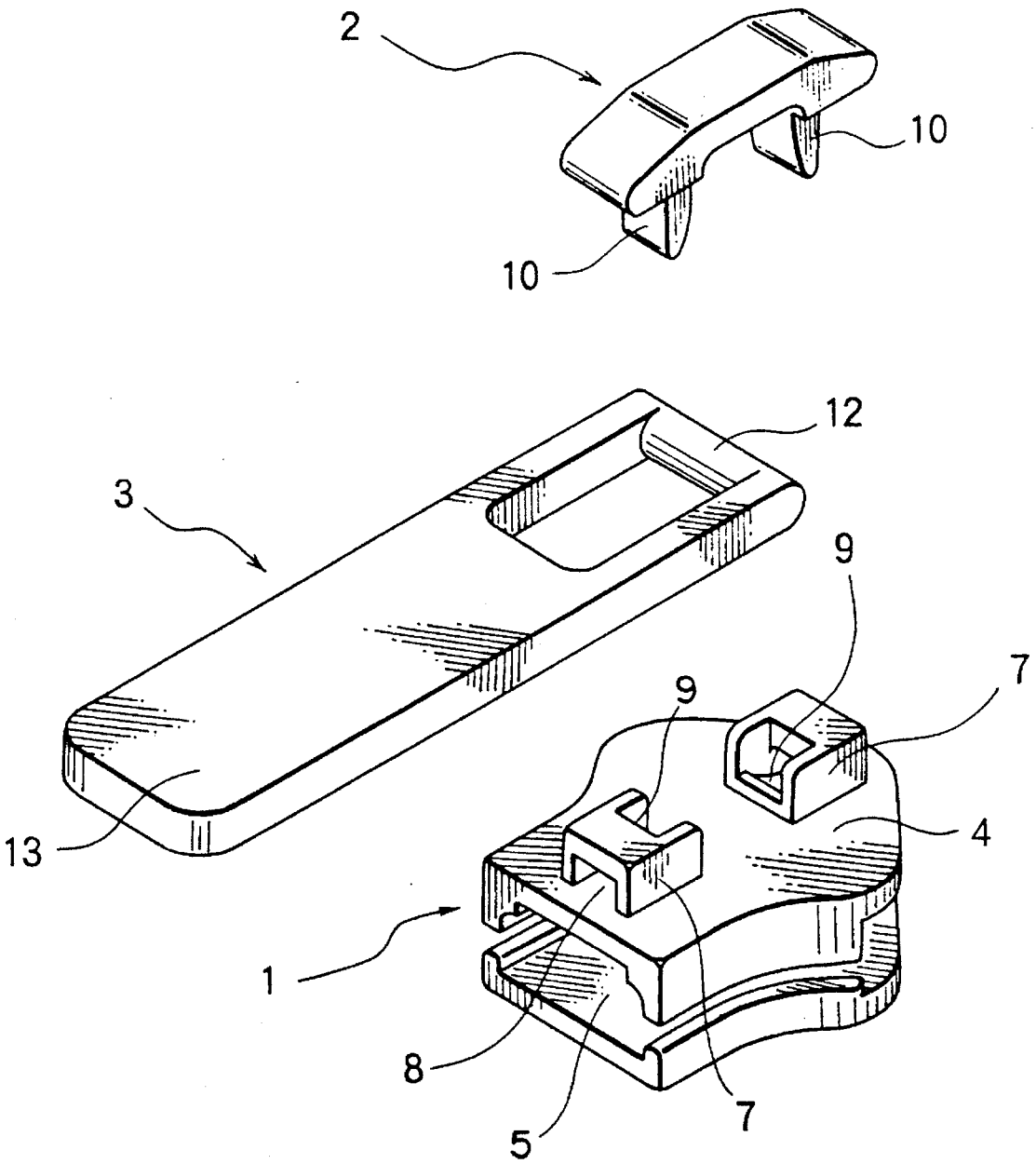
FIG. 1 is an exploded perspective view of a slide fastener, glider according to a first embodiment of the invention, which is to be assembled as a pull tab retaining bar is supplied to a slider body vertically from the upper side.
Figure 2:
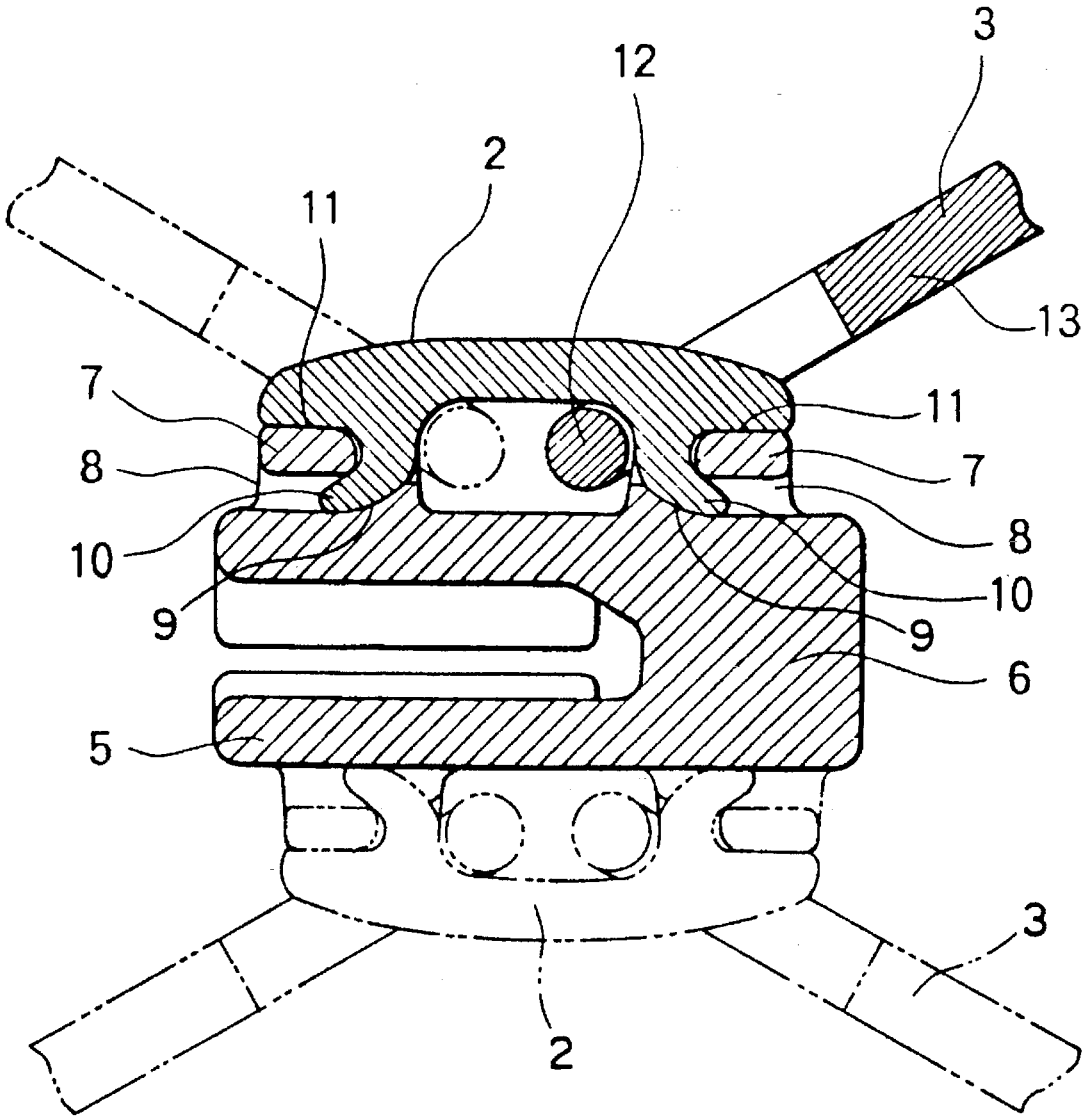
FIG. 2 is a longitudinal cross-sectional view of the slider of FIG. 1, showing the slider having been assembled.

In automatic assembly of the slider of FIGS. 1 through 11 which show a first embodiment of the invention, the pull tab retaining bar 2 is supplied to the slider body 1 placed on a turntable of an automatic assembling machine vertically from the upper side and then the pull tab retaining bar 2 is plastically deformed so as to attach the pull tab 3 to the slider body 1, As shown in FIGS. 1 and 2, the slider body 1 is composed of upper and lower wings 4, 5 joined together by a central guide post 6. The upper wing 4 has on its upper surface front and rear attachment lugs 7, 7 to which the pull tab retaining bar 2 is to be attached. Each of the attachment lugs 7 has an insertion hole 8 of a rectangular cross section extending horizontally from the outer side and longitudinally of the slider body 1, and a guide surface 9 contiguous to the insertion hole 8 at the inner side. An upper end portion of the guide surface 9 is defined to be an opening. Preferably, the guide surface 9 is arcuately curved.

The pull tab retaining bar 2 has a length so as to bridge over the front and rear attachment lugs 7, 7, and also has on its lower surface at opposite ends a pair of legs 10 to be inserted into the respective insertion holes 8 of the front and rear attachment lugs 7, 7. Each leg 10 is tapered to an end and has on the outer side a flat surface 11 touchable with the upper surface of the attachment lug 7. Thus as a whole the pull tab retaining bar 2 has a Π shape. The pull tab 3 has at one end a pintle 12 and at the other end a grip 13.

In the previous illustrated example, the two attachment lugs 7 are arranged on the upper wing 4 of the slider body 1. Alternatively, in a double-faced slider, another pair of attachment lugs may be arranged on the lower wing 5 for holding another pull tab retaining bar 2 to attach another pull tab 3 to the lower wing 5. Further, this invention may be applied also to an automatic lock slider having an automatic locking mechanism.

For assembly, with the pintle 12 of the pull tab 3 placed on the upper surface of the upper wing 4 of the slider body 1 which is placed on the turntable of the automatic assembling machine, between the front and rear attachment lugs 7, 7, the pull tab retaining bar 2 is supplied to the slider body 1 from the upper side until the distal ends of the legs 10, 10 of the pull tab retaining bar 2 come into contact with the respective guide surfaces 9, 9 of the front and rear attachment lugs 7, 7. Then the pull tab retaining bar 2 is pressed to insert the legs 10, 10 into the respective insertion holes 8, 8 along the guide surfaces 9, 9. As a result, the pull tab retaining bar 2 is secured to the slider body 1 by plastic deformation, obtaining a completely assembled slider.

Figure 3:
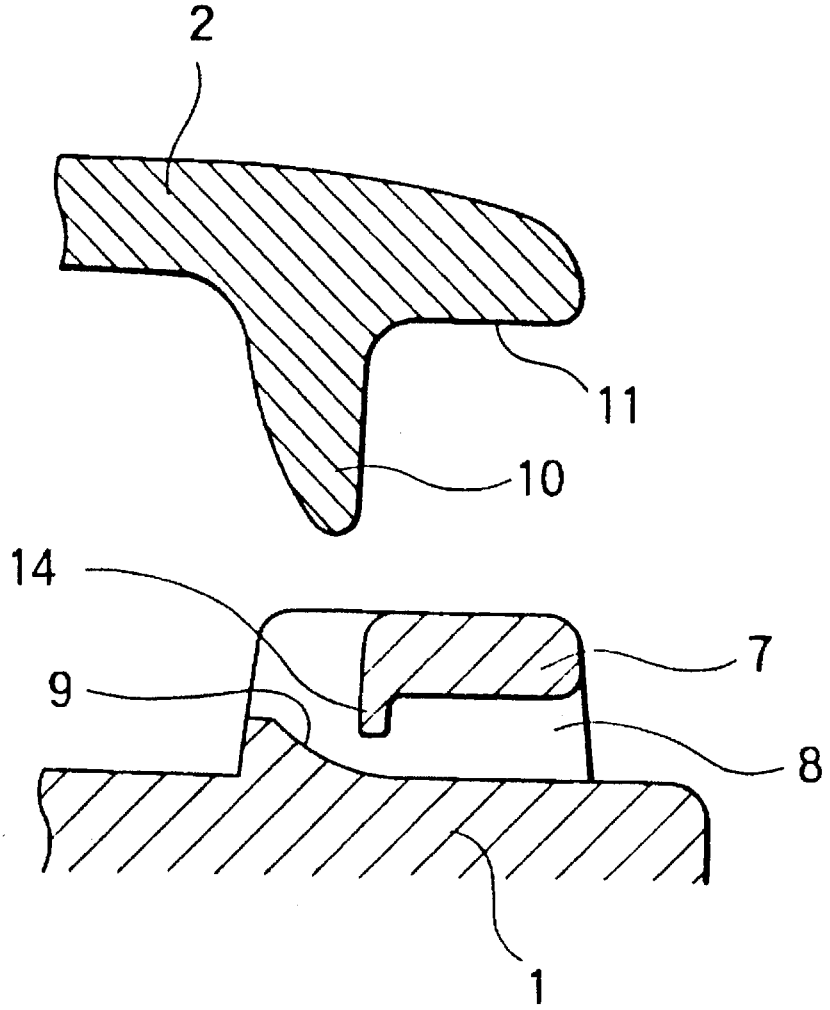
FIG. 3 is a fragmentary longitudinal cross-sectional view of the slider, showing a modification of an insertion hole.
Figure 4:
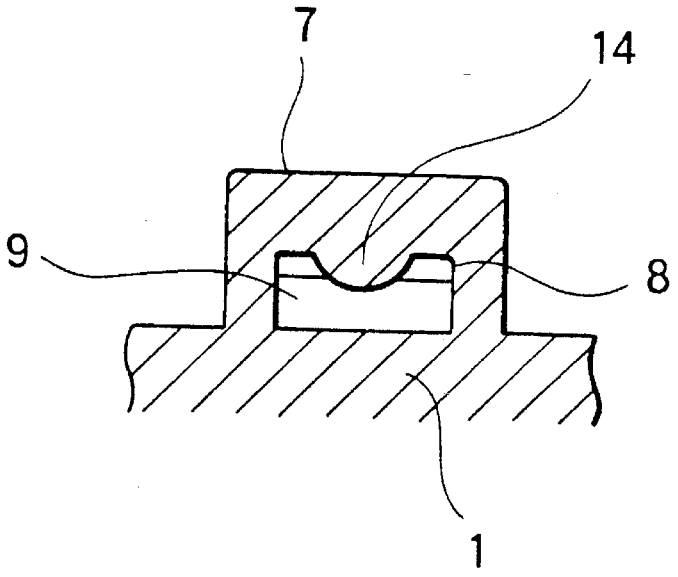
FIG. 4 is a fragmentary transverse cross-sectional view of FIG. 3, showing the modified insertion hole.
Figure 5:
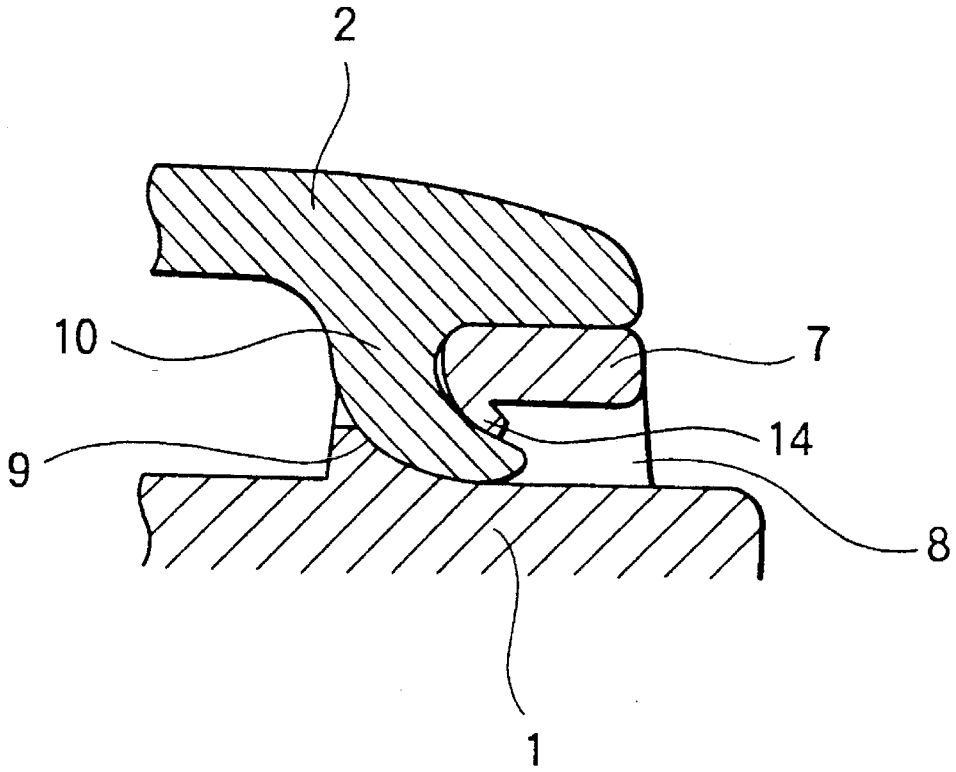
FIG. 5 is a fragmentary longitudinal cross-sectional view of the slider of FIG. 3, showing the pull tab retaining bar having been,attached to the attachment lug.

FIGS. 3 through 5 shows a modified attachment lug 7 standing on the slider body 1. The modified attachment lug 7 has a tongue 14 projecting vertically from the inner end of the insertion hole 8 at the upper side toward the guide surface 9. Once the leg 10 of the pull tab retaining bar 2 is forced into the insertion hole 8 of the attachment lug 7, the tongue 14 plastically deforms to press the leg 10 to cause a resisting force acting against removal of the leg 10 from the insertion hole 8. In an alternative way for preventing the leg 10 from being removed from the insertion hole 8, the tongue 14 may have a serrated surface which is touchable with the upper side of the insertion hole 8.

Figure 6:
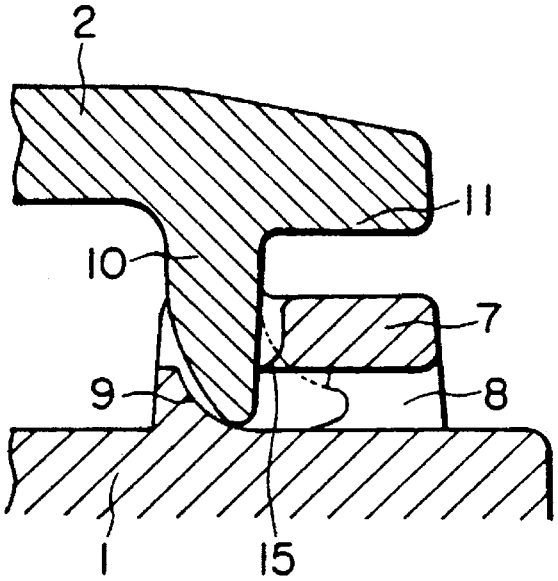
FIG. 6 is a fragmentary longitudinal cross-sectional view of the slider of FIG. 3, showing a modification of the attachment lug.
Figure 7:
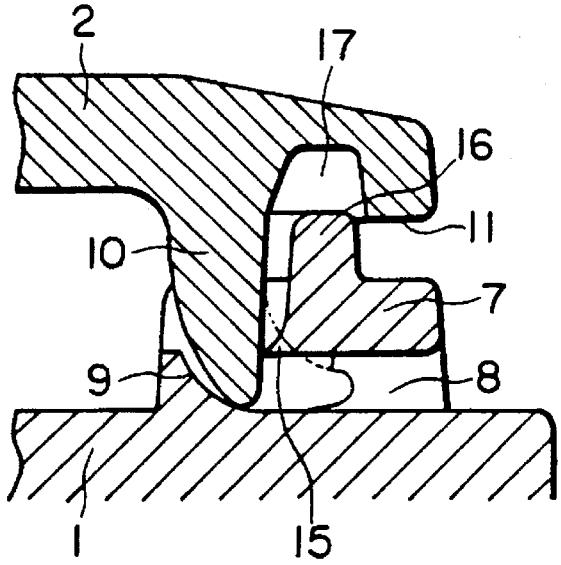
FIG 7 is a fragmentary longitudinal cross-sectional view of the slider of FIG. 3, showing a modification of both the attachment lug and the pull tab retaining bar.

FIGS. 6 and 7 show an improved form of the tongue 14 provided in the insertion hole 8 of the attachment lug 7. There is provided a space between an inner wall surface of the insertion hole 8 of the attachment lug 7 and the leg 10. This space is defined in order to have a wedge shaped claw 15 which is provided at a corner end of the insertion hole 8 and facing the guide surface 9 and which serves to prevent removal of the leg 10. When the leg 10 is inserted into the insertion hole 8 and the pull tab retaining bar 2 is pressed forcibly, the claw 15 engages a surface of the claw 15 so as to bend and contact tightly.

Figure 8:
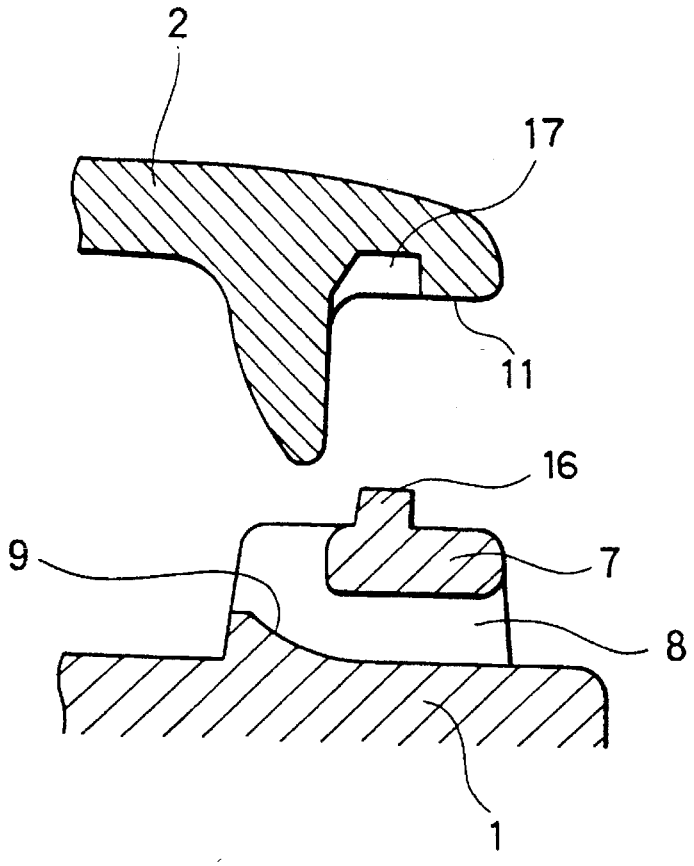
FIG. 8 is a fragmentary longitudinal cross-sectional view of the slider, showing another modification of both the attachment lug and the pull tab retaining bar.
Figure 9:
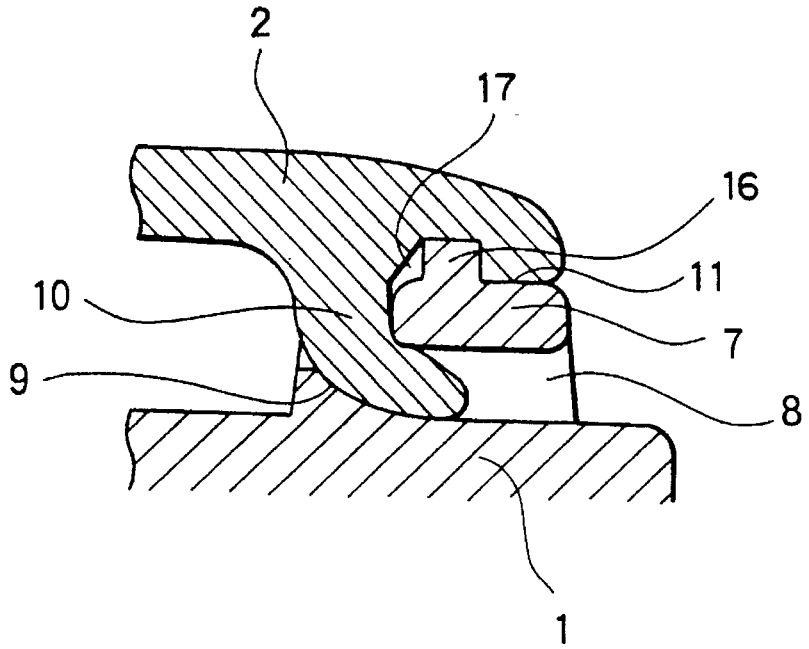
FIG. 9 is a fragmentary longitudinal view of the slider of FIG. 8, showing the modified pull tab retaining bar having been attached to the modified attachment lug.

Further, FIGS. 7, 8 and 9 show an improvement to the contact surfaces of an upper surface of the attachment lug 7 and a flat surface 11 of the pull tab retaining bar 2. The attachment lug 7 has on its upper surface a projection 16. The projection 16 of FIGS. 8 and 9 is slightly inclined toward the outer side.

On the other hand, the pull tab retaining bar 2 has in its lower flat surface 11 at a position near the base of the leg 10 a recess 17 to which the projection 16 is to be fitted so as to firmly attach the pull tab retaining bar 2 to the attachment lugs 7.

Figure 10:
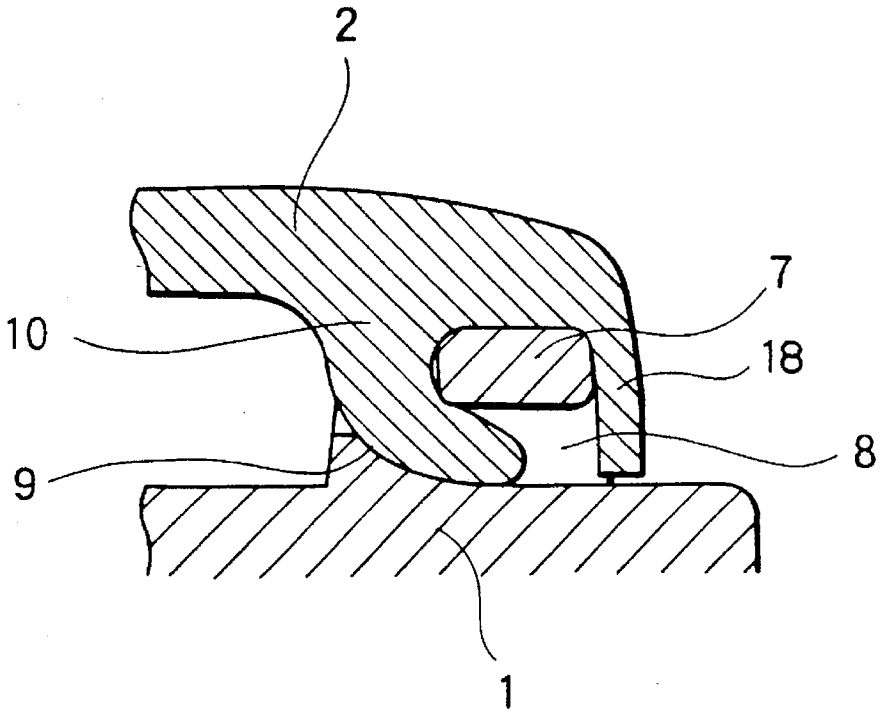
FIG. 10 is a fragmentary longitudinal view of the slider, showing another modification of the pull tab retaining bar.

FIG. 10 shows a modified pull tab retaining bar 2. The modified pull tab retaining bar 2 has a pair of covering strips 18 extending from the respective ends. The covering strips 18 are bent when the pull tab retaining bar 2 is attached to the attachment lugs 7 by pressing, for covering outer ends of the insertion holes 8 of the front and rear attachment lugs 7. The covering strips 18 may be curved previously.

Figure 11:
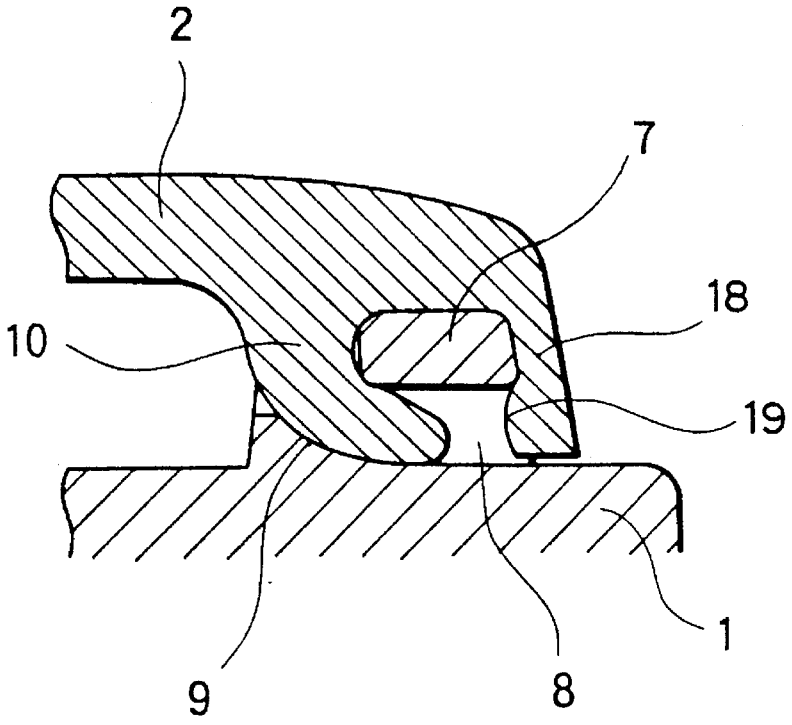
FIG. 11 is a fragmentary longitudinal view of the slider of FIG. 10, showing still another modification of the pull tab retaining bar.

FIG. 11 shows a modified covering strip 18 of the pull tab retaining bar 2. The modified covering strip 18 has on its inner surface of its free end a small projection 19 which is to be fitted in the outer end of the insertion hole 8, serving to assist in preventing the pull tab retaining bar 2 from being removed off the attachment lugs 7.

Figure 12:
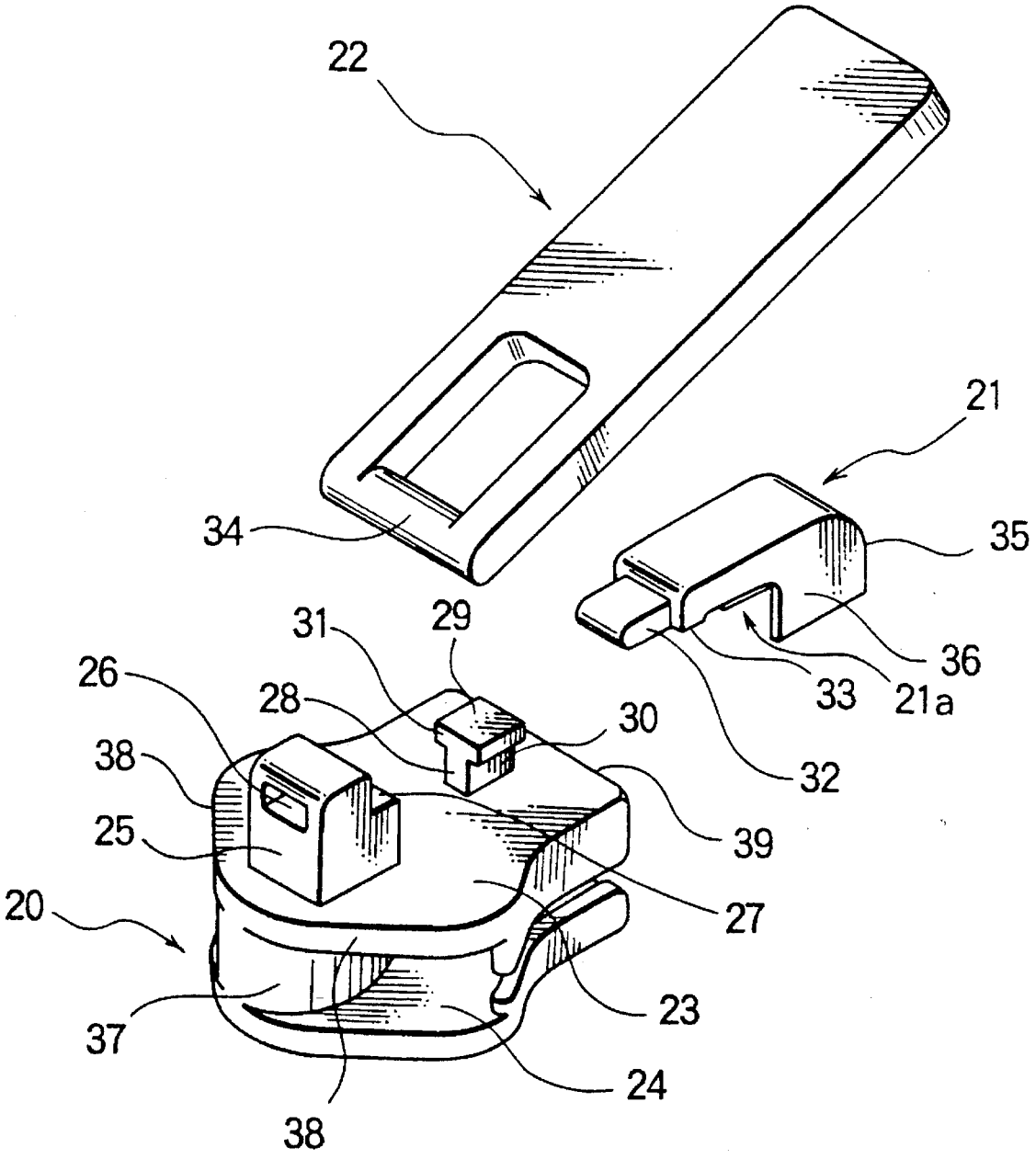
FIG. 12 is an exploded perspective view of an alternative slide fastener slider according to a second embodiment of the invention, which is to be assembled as a pull tab retaining bar is supplied to a slider body horizontally.
Figure 13:
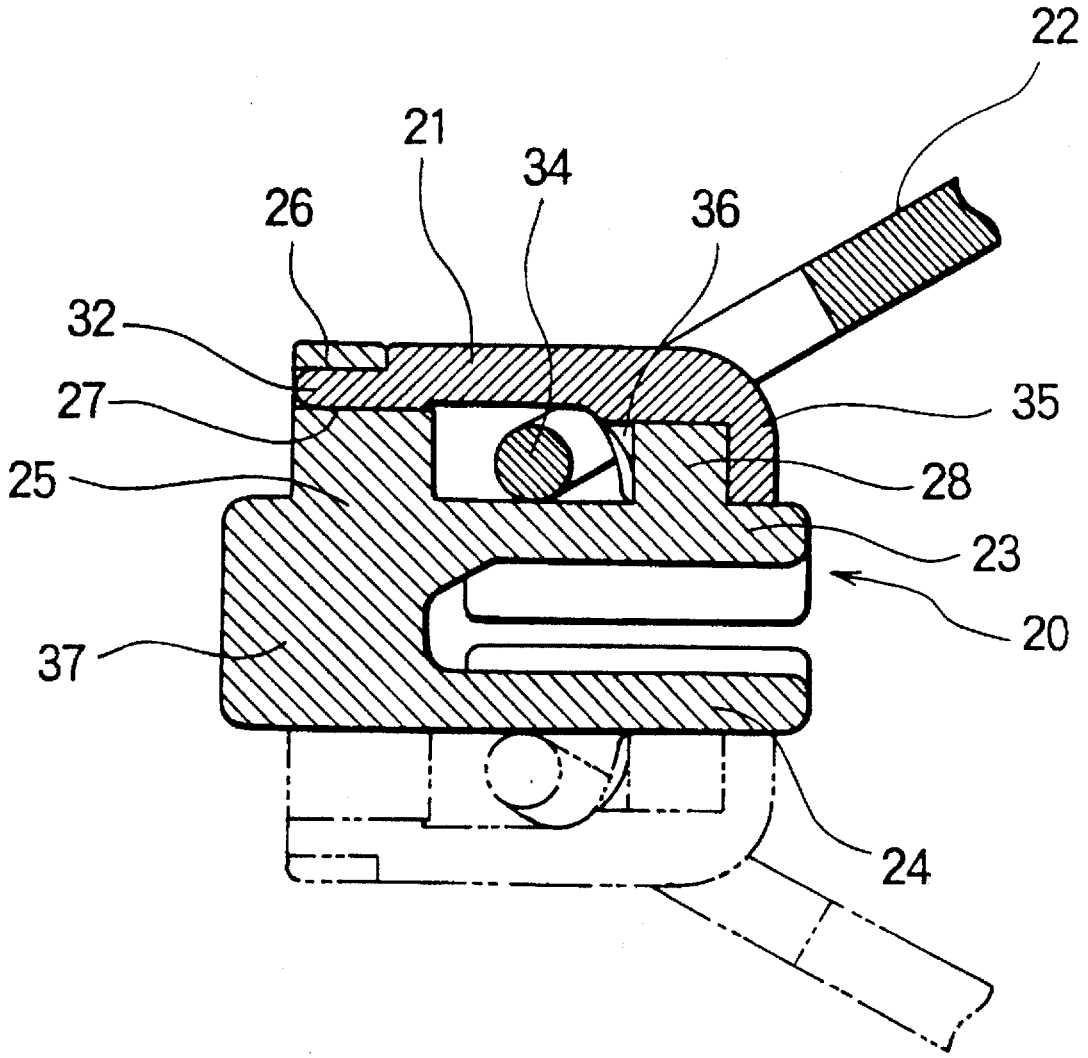
FIG. 13 is a longitudinal cross-sectional view of the slider of FIG. 12, showing the slider having been assembled.
Figure 14:
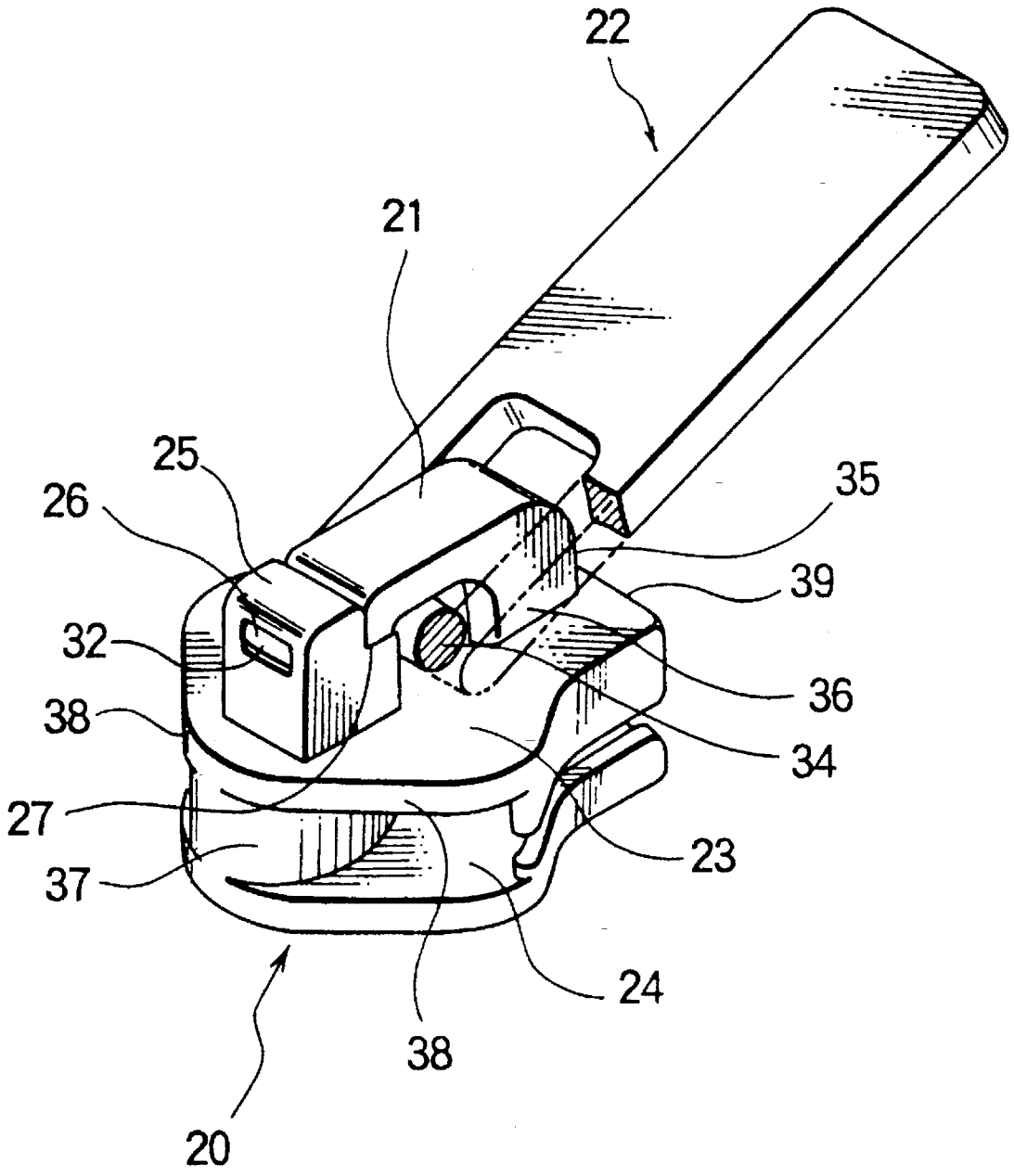
FIG. 14 is a perspective view of the slider having been assembled.
Figure 15:
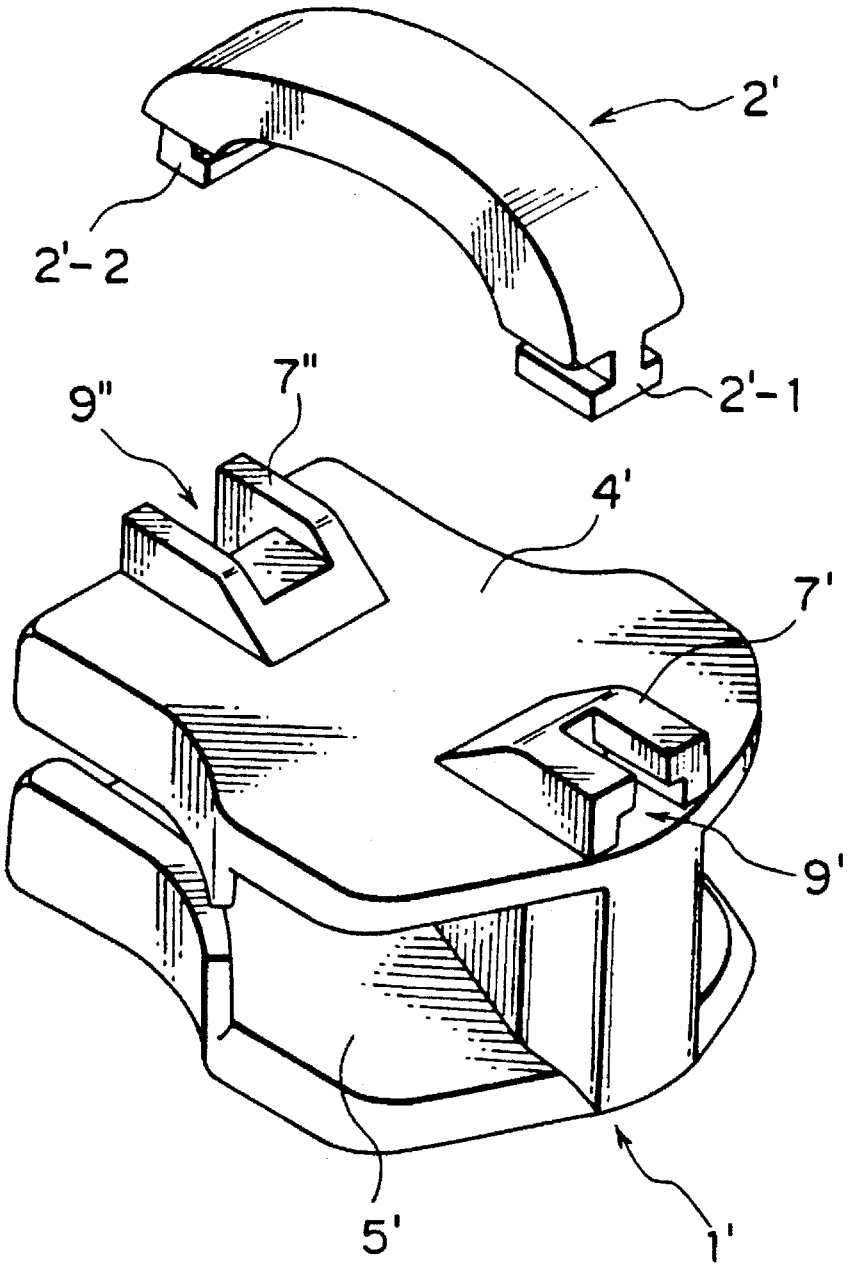
FIG. 15 (PRIOR ART)
FIG. 15 is an exploded perspective view of a prior art slider.
Figure 16:
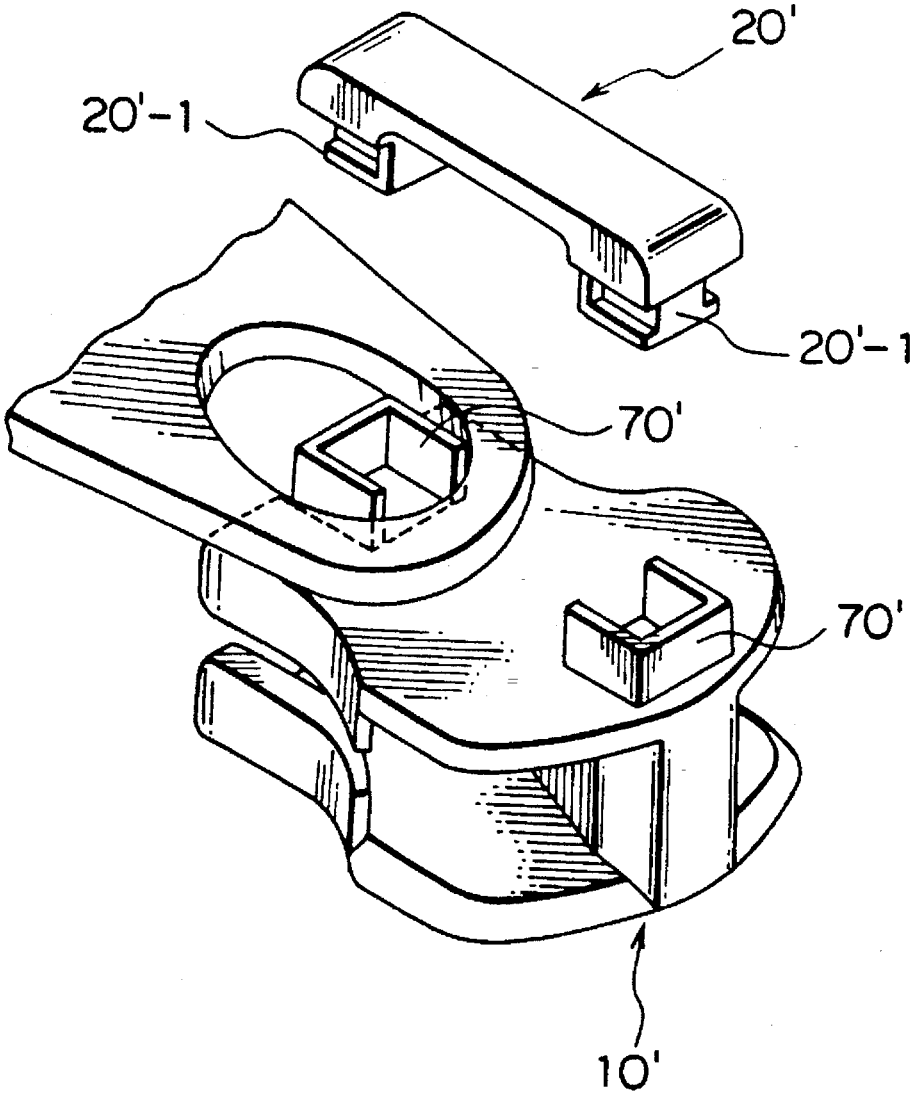
FIG. 16 (PRIOR ART)
FIG. 16 is an exploded perspective view of another prior art slider.
Figure 17:
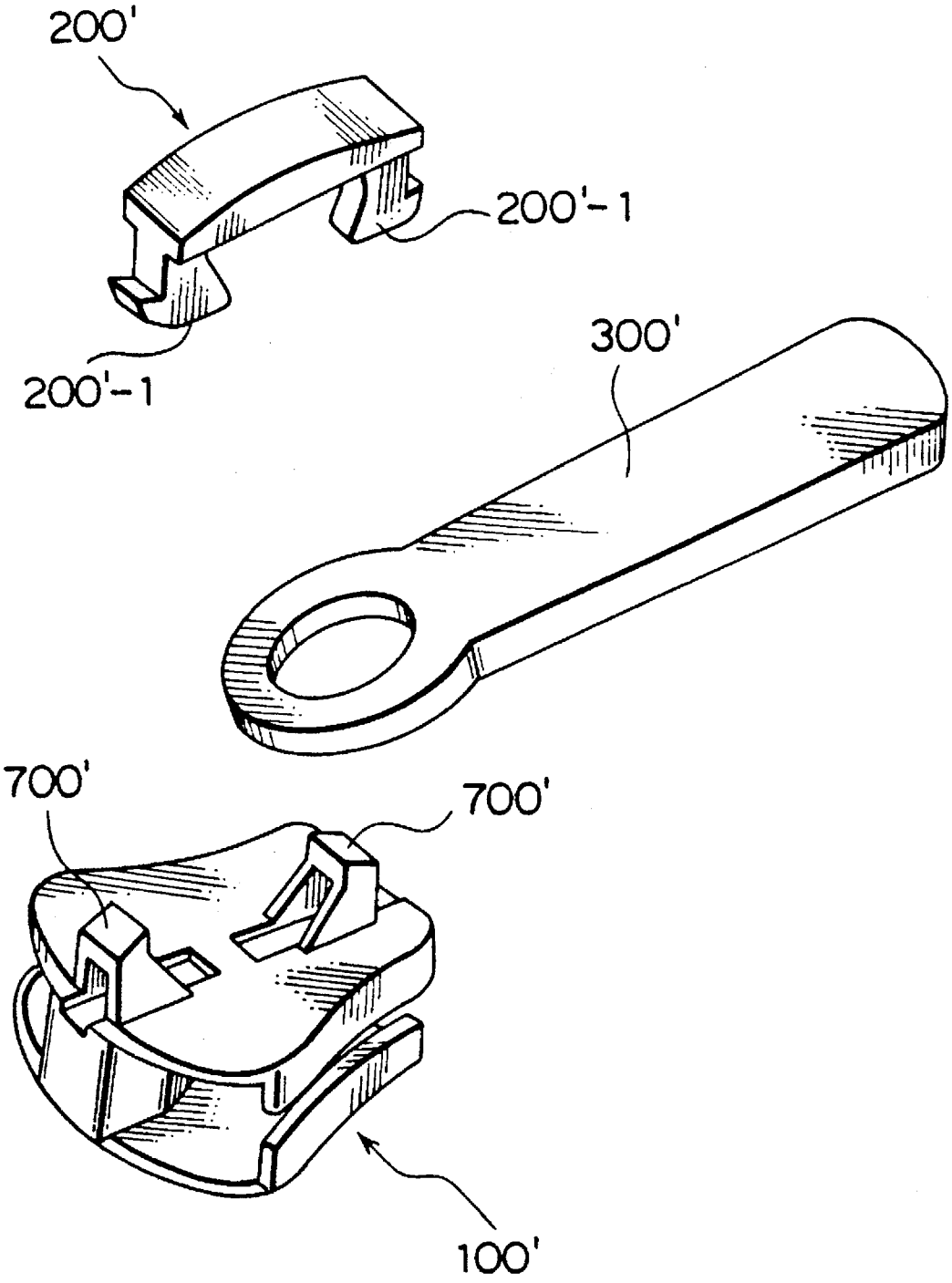
FIG. 17 (PRIOR ART)
FIG. 17 is an exploded perspective view of still another prior art slider.

FIGS. 12 through 14 show a second embodiment which is somewhat different from the first embodiment, and in an automatic assembling process, a pull tab retaining bar 21 is supplied horizontally to a slider body 20 which is placed on the turntable of the automatic assembling machine and is then plastic-deformed to attach the pull tab 22.

In this slider, like the slider of the foregoing embodiment, the slider body 20 is composed of upper and lower wings 23, 24 joined together by a central guide post 37. The attachment lug 25 projects from the upper surface of the upper wing 23 at a position toward a front end or shoulder 38 of the slider body 20 and has at the front side a horizontal insertion hole 26 of a rectangular cross section. A rear portion of the insertion hole 26 opens and the same surface extends as a horizontal guide surface 27 contiguous to the insertion hole 26.

The supporting lug 28 projects from the upper surface of the upper wing 23 at a position toward a rear end opening 39. The supporting lug 28 has a top surface 29 having the same level with both the insertion hole 26 and the guide surface 27 of the attachment lug 25 disposed toward the front side of the upper wing 23. Further, the supporting lug 28 has a pair of side recesses 30 one on each side so as to form an enlarged head 31, thus assuming a T-shape transverse cross section as a whole. The enlarged head 31 has a width substantially equal to that of the insertion hole 26.

The pull tab retaining bar 21 has a generally key-shape contour. Specifically, the pull tab retaining bar 21 has at its front stepped end 33 a horizontal leg 32 of a rectangular cross section to be inserted into the insertion hole 26 so that the front stepped end 33 may be placed on the guide surface 27. The pull tab retaining bar 21 further has at its rear end a socket 35 defined by a surrounding wall 36 closing at three sides so as to accommodate and to be clenched against the supporting lug 28. The lower surface of the front stepped end 33 and the lower surface of the front leg 32 as well as other contact surfaces touchable with the top surface 29 of the supporting lug 28 are in a common level. A pull tab 22 has at one end a pintle 34.

The attachment lug 25 and the supporting lug 28 may be arranged not only on the upper wing 23 of the slider body 20 but on the lower wing 24, and the pull tab retaining bars 21 may be attached respectively so as to form a double-sided slider.

For assembling the slider, with the pintle 34 of the pull tab 22 placed on the upper wing 23 of the slider body 20 between the attachment lug 25 and the supporting lug 28, the pull tab retaining bar 21 is supplied horizontally, i.e. from the side toward the supporting lug 28 to the slider body 20 placed on the turntable of the automatic assembling machine, so that the front leg 32 of the front stepped end 33 of the pull tab retaining bar 21 is inserted into the insertion hole 26 as it slides along the guide surface 27 of the attachment lug 25, while the supporting lug 28 is received in the socket 35. Then the surrounding wall 36 of the socket 35 is clenched against the side recesses 30 of the supporting lug 28 from opposite sides to secure the pull tab retaining bar 21, attaching the pull tab 22 to the slider body 20. As a result, a completely assembled slider is obtained.

With the slider of this invention, the following advantageous results can be realized.

Since the slider is made of metal and composed of three members of the slider body 1, the pull tab 3, and the pull tab retaining bar 2, with the front and rear attachment lugs 7 each having the insertion hole 8 and the guide surface 9 contiguous to the insertion hole 8 stand from the upper surface of the slider body 1, and since the pull tab retaining bar 2 has the pair of legs 10 to be inserted into the respective insertion holes 8 of the front and rear attachment lugs 7 with the pintle 12 being placed on the slider body 1, the slider is most suitable for automatic assembling process, and the slider can be manufactured easily at a high speed, thus improving the rate of production.

In attaching the pull tab retaining bar 2 to the attachment lugs 7, since the legs 10 of the pull tab retaining bar 2 are inserted into the insertion holes 8 as they are bent along the guide surfaces 9 by plastic deformation, it is possible to attach the pull tab retaining bar 2 to the attachment lugs 7 accurately in a simple process as compared to the conventional art. This slider is therefore most suitable to be automatically assembled. The assembled slider is free from any damage due to the process and is hence neat in appearance as well as is unyielding.

And since the attachment lug 7 having the insertion hole 8 is provided to project from each of the upper and lower wings 4, 5 and the pull tab retaining bar 2 is attached to each of the attachment lugs 7 so as to form the double-sided slider, the sturdy double-sided slider of a simple structure composed of three members of the slider body 1, the pull tab 3, and the pull tab retaining bar 2 can be assembled accurately and automatically.

Due to the form of the attachment lug 7 and the pull tab retaining bar 2, it is possible to plastic-deform the pull tab retaining bar 2 only by pressing the pull tab retaining bar 2 vertically toward the slider body 1. Thus the pull tab retaining bar 2 can be attached to the attachment lugs 7 easily and the slider is most suitable for the turntable-type automatic assembling machine.

Further, since the pull tab retaining bar 2 can be molded on a horizontally split die, a slider neat in appearance as free from any parting line on the surface of the pull tab retaining bar 2 unlike the conventional slider can be obtained.

Partly since the guide surfaces 9 of the attachment lugs 7 are arcuately curved and partly since each of the legs 10 of the pull tab retaining bar 2 is tapered off, plastic deformation of the legs 10 can take place easily, so that the pull tab retaining bar 2 can be attached smoothly.

With the tongue 14 projecting from the inner and upper end of the insertion hole 8 toward the guide surface 9, it is possible to contact the leg 10 tightly with the insertion hole 8, so that the slider body 1 and the pull tab retaining bar 2 can be attached to each other stably.

Since the space is defined between the inner side wall of the insertion hole 8 and the leg 10, and since the wedge shaped claw 15 for preventing removal of the leg 10 is provided confronting the guide surface 9 at the corner end of the insertion hole 8, the claw 15 presses one surface of the leg 10 when the pull tab retaining bar 2 is pressed, thus the claw 15 bites the leg 10 and bend to contact tightly with the leg 10, preventing removal of the pull tab retaining bar 2. Further, due to the presence of the space and the claw 15, plastic deformation takes place locally at the end portion of the leg 10 and proceeds gradually so that the base of the leg 10 does not get damaged.

Partly since the attachment lug has on its upper surface the projection 16, and partly since the pull tab retaining bar 2 has in its lower flat surface at the position near the base of the leg 10 the recess 17 to which the projection 16 is to be fitted, it is possible to attach the pull tab retaining bar 2 to the attachment lugs 7 with increased firmness.

As the pull tab retaining bar 2 has the pair of covering strips 18 extending from the respective ends, for covering outer ends of the insertion holes 8 of the front and rear attachment lugs 7, it is possible to make the overall appearance of the slider much more sightly.

In the slider of the second embodiment of the invention, with the structure as described above, it is possible to supply the pull tab retaining bar 21 horizontally to the slider body 20 accurately and smoothly and also to clench the surrounding wall 36 of the socket 35 against the supporting lug 28 from opposite sides. Therefore the slider can be assembled using a reduced-height assembling mechanism. This slider is particularly suitable to be manufactured by a small-size machine and can be assembled with ease, having adequate sturdiness.

Since the supporting lug 28 on the slider body 20 is in a T-shape, and since the socket 35 of the pull tab retaining bar 21 is consists of the surrounding wall 36 with one side being open, the pull tab retaining bars 21 can be supplied horizontally sliding on the supporting lug 28 and the clenching process can be performed easily, thus the sturdy slider can be obtained.

And partly since the insertion hole 26 and the guide surface 27 horizontally defined in the attachment lug 25 have the same level as the top surface 29 of the supporting lug 28, and partly since the contact surface of the pull tab retaining bar 21 is one, the pull tab retaining bar 21 can be fed accurately and smoothly and can be attached stably.

What is claimed is:

1. A slider for a slide fastener, comprising:

(a) a slider body having upper and lower wings;

(b) a pair of attachment lugs projecting from an upper surface of said upper wing, each attachment lug having an insertion hole and a guide surface contiguous to said insertion hole;

(c) a pull tab having a pintle; and (d) a pull tab retaining bar having a pair of legs each fitted in one of said insertion holes of each of said attachment lugs so as to define between said pull tab retaining bar and said upper surface of said upper wing an opening through which said pintle of said pull tab is to be inserted, said guide surfaces shaped to plastically bend said legs during insertion into said insertion holes to lock said retaining bar to said upper wing.

2. A slider for a slide fastener according to claim 1, wherein said pull tab retaining bar has a pair of covering strips extending from the respective ends for covering outer ends of said insertion hole of said attachment lug.

3. A slider for a slide fastener according to claim 1, wherein said slider is a double-faced type and further comprising another pair of attachment lugs projecting from a lower surface of said lower wing, another pull tab retaining bar, and another pull tab for being pivotally retained by said pull tab retaining bar.

4. A slider for a slide fastener, comprising:

(a) a slider body having upper and lower wings;

(b) a pair of attachment lugs projecting from an upper surface of said upper wing, each attachment lug having an insertion hole and a guide surface contiguous to said insertion hole;

(c) a pull tab having a pintle; and (d) a pull tab retaining bar having a pair of legs each fitted in one of said insertion holes of each of said attachment lugs so as to define between said pull tab retaining bar and said upper surface of said upper wing an opening through which said pintle of said pull tab is to be inserted;

wherein said insertion hole of each of said attachment lugs extends horizontally and longitudinally on said upper wing and said guide surface of each of said attachment lugs inclines sloping down to one end of said insertion hole, and wherein said pull tab retaining bar has a generally $\pi$ shape with said legs projecting from a lower surface of said pull tab retaining bar at opposite ends and being plastically deformable when said pull tab retaining bar is pressed for attachment to said attachment lugs.

5. A slider fastener, comprising:

(a) a slider body having upper and lower wings;

(b) a pair of attachment lugs projecting from an upper surface of said upper wing, each attachment lug having an insertion hole and a guide surface contiguous to said insertion hole;

(c) a pull tab having a pintle; and (d) pull tab retaining bar having a pair of legs each fitted in one of said insertion holes of each of said attachment lugs so as to define between said pull tab retaining bar and said upper surface of said upper wing an opening through which said pintle of said pull tab is to be inserted;

wherein said guide surface of each of said attachment lugs is arcuately curved, and each of said legs confronting and to be contacted with said guide surface is tapered off.

6. A slider for a slide fastener comprising:

(a) slider body having upper and lower wings;

(b) a pair of attachment lugs projecting from an upper surface of said upper wing, each attachment lug having an insertion hole and a guide surface contiguous to said insertion hole;

(c) a pull tab having a pintle; and (d) a pull tab retaining bar having a pair of legs each fitted in one of said insertion holes of each of said attachment lugs so as to define between said pull tab retaining bar and said upper surface of said upper wing an opening through which said pintle of said pull tab is to be inserted;

wherein each of said attachment lugs has a tongue to be pressed against said respective each leg, projecting from an inner end of said insertion hole toward said guide surface.

7. A slider for a slide fastener, comprising:

(a) a slider body having upper and lower wings;

(b) a pair of attachment lugs projecting from an upper surface of said upper wing, each attachment lug having an insertion hole and a guide surface contiguous to said insertion hole;

(c) pull tab having a pintle; and (d) a pull tab retaining bar having a pair of legs each fitted in one of said insertion hole of each of said attachment lugs so as to define between said pull tab retaining a bar and said upper surface of said upper wing an opening through which said pintle of said pull tab is to be inserted:

wherein each of said attachment lugs has on its upper surface a projection, and said pull tab retaining bar has in its lower surface at a position outside and near a base of each said leg a recess in which said projection is to be fitted.

8. A slider for a slide fastener, comprising:

(a) slider body having upper and lower wings;

(b) pair of attachment lugs projecting from an upper surface of said upper wing, each attachment lug having an insertion hole and a guide surface contiguous to said insertion hole:

(c) pull tab having a pintle; and (d) pull tab retaining bar having a pair of legs each fitted in one of said insertion holes of each of said attachment lugs so as to define between said pull tab retaining bar and said upper surface of said upper wing an opening through which said pintle of said pull tab is to be inserted;

wherein a space is defined between an inner side wall of said insertion hole and said leg, and a wedge shaped claw for preventing removal of said leg is provided confronting said guide surface at a corner end of said insertion hole.

9. A slider for a slide fastener, comprising:

(a) a slider body having upper and lower wings;

(b) an attachment lug and a supporting lug projecting from an upper surface of said upper wing, said attachment lug standing on said upper surface of said upper wing at one end, and said supporting lug standing on the upper surface at a distance from said attachment lug toward another end;

(c) said attachment lug having an insertion hole and a horizontal guide surface contiguous to said insertion hole while said supporting lug has an enlarged head;

(d) a pull tab having a pintle;

(e) a pull tab retaining bar having at one end a leg to be fitted in said insertion hole of said attachment lug so as to define between said pull tab retaining bar and said upper surface of said upper wing an opening through which said pintle of said pull tab is to be inserted; and (f) wherein at an end of said pull tab retaining bar opposite to said leg a socket is formed which is shaped to accommodate said supporting lug enlarged head and composed of a plastically deformable material to be clenched against the supporting lug, whereby said pull tab retaining bar is attached onto said upper wing.

10. A slider for a slide fastener according to claim 9, wherein said supporting lug has a T-shape contour while said socket of said pull tab retaining bar comprises a surrounding wall closing three sides.

11. A slider for a slide fastener according to claim 9, wherein said horizontal insertion hole and guide surface of said attachment lug are on the same level with a top surface of the supporting lug, and said pull tab retaining bar has contact surfaces, which are touchable with said insertion hole, said guide surface and said top surface, on said same level.

12. A slider for a slide fastener according to claim 9, wherein said slider is a double-faced type and further comprising another attachment lug and supporting lug projecting from a lower surface of said lower wing, another pull tab retaining bar, and another pull tab for being pivotally retained by said pull tab retaining bar.

* * * * *